United States Patent [19]

Goldschild et al.

[11] 3,950,021

[45] Apr. 13, 1976

[54] PULLING AND RUNNING TOOL

[75] Inventors: Pierre Goldschild, Paris; Bernard Doremus, Fontainebleau, both of France

[73] Assignee: Schlumberger Technology Corporation, New York, N.Y.

[22] Filed: July 29, 1974

[21] Appl. No.: 492,798

[52] U.S. Cl. ..... 294/86.28; 294/86.29; 294/86.3; 294/86.33

[51] Int. Cl.[2] ..... E21B 31/12

[58] Field of Search..... 294/86.1, 86.14, 86.15, 294/86.18, 86.24, 86.25, 86.26, 86.28–86.33, 115, 116; 166/99, 209, 217

[56] References Cited

UNITED STATES PATENTS

| | | | |
|---|---|---|---|
| 1,481,259 | 1/1924 | Harrison | 294/86.28 |
| 1,573,646 | 2/1926 | Schiefferle et al. | 294/86.28 |
| 1,575,185 | 3/1926 | Stenhouse | 294/116 X |
| 1,657,788 | 1/1928 | Clark | 294/116 X |
| 3,152,829 | 10/1964 | Steele | 294/86.18 |
| 3,152,830 | 10/1964 | Pounder et al. | 294/115 X |
| 3,175,720 | 3/1965 | Millot et al. | 294/116 X |
| 3,758,145 | 9/1973 | Kinley | 294/86.29 |

*Primary Examiner*—Evon C. Blunk
*Assistant Examiner*—Johnny D. Cherry
*Attorney, Agent, or Firm*—David L. Moseley; William R. Sherman; Stewart F. Moore

[57] ABSTRACT

In accordance with an illustrative embodiment of the present invention as disclosed herein, a wireline pulling and running tool can be preset at the surface by simple adjustment for functioning as either a pulling or a running tool, and for release from an associated hanger mandrel by jarring either upwardly or downwardly. A tubular support that carries pivotally mounted gripping elements which are yieldably urged toward disengaged position, has a control body movably mounted therein. The control body has a plurality of sets of circumferentially spaced recess means than can be selectively aligned with the gripping members to enable release thereof in response to vertical movement of the control body from an initial upper or lower position where the body is releasably fixed to the support by a shear pin.

21 Claims, 16 Drawing Figures

FIG. 1
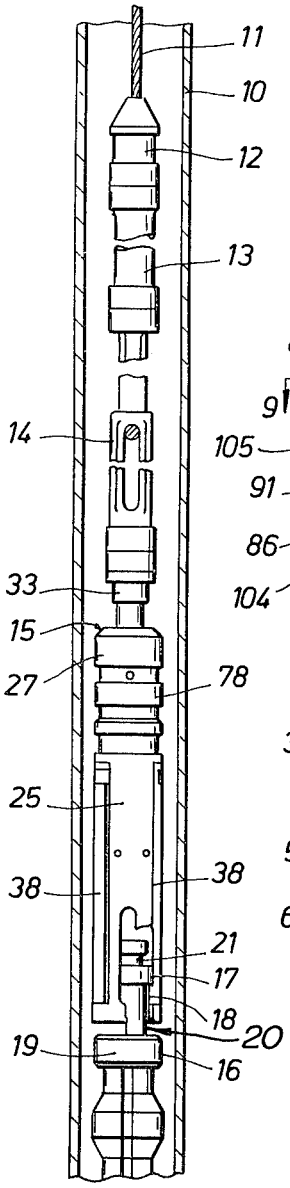
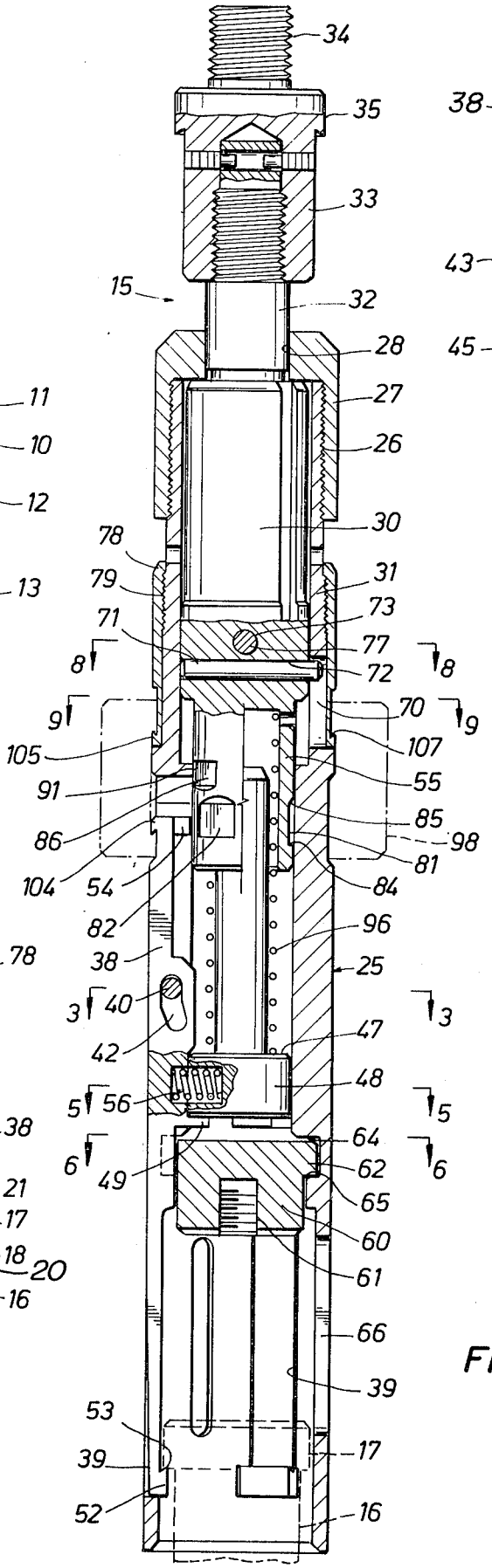
FIG. 2
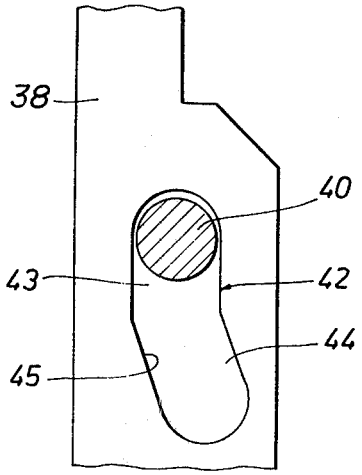
FIG. 4

FIG. 3
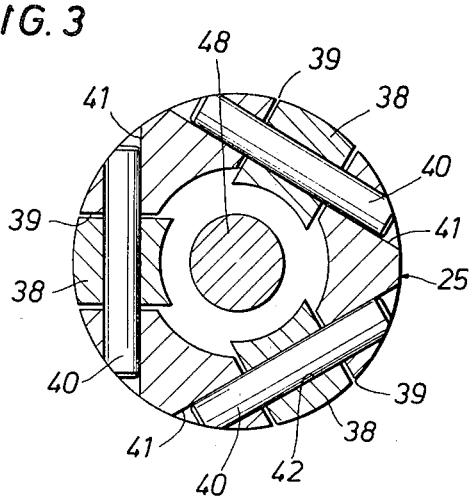
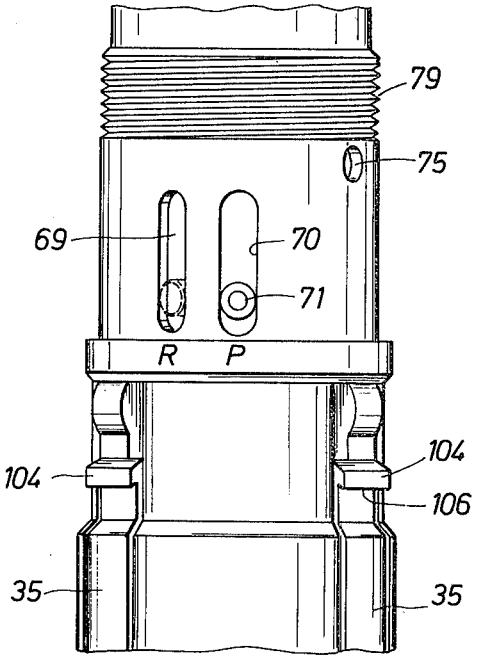
FIG. 7
FIG. 5
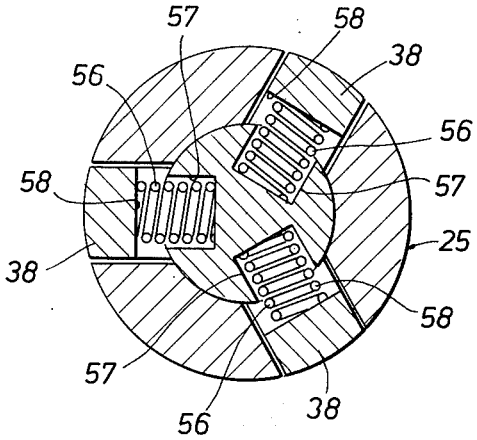
FIG. 8
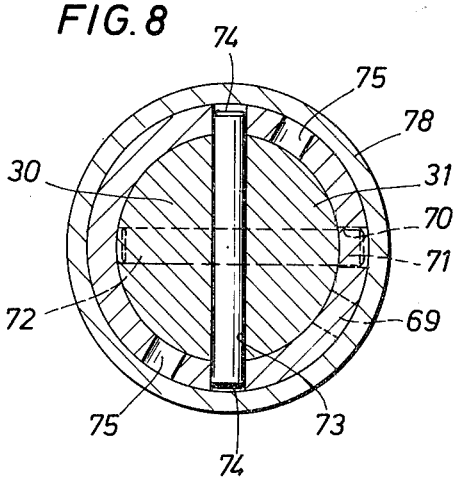
FIG. 6
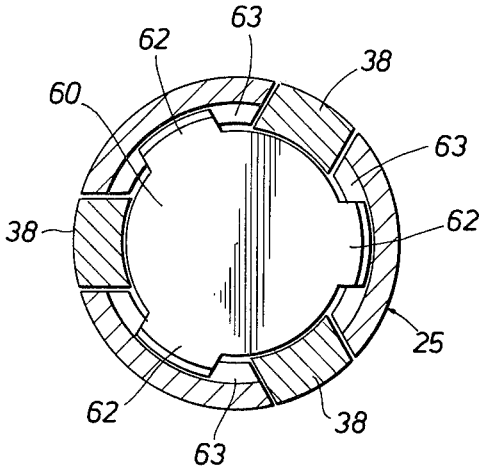
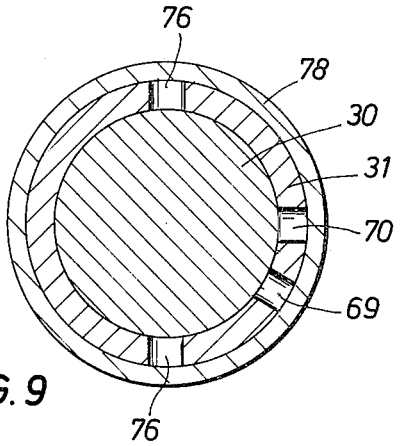
FIG. 9

FIG. 10
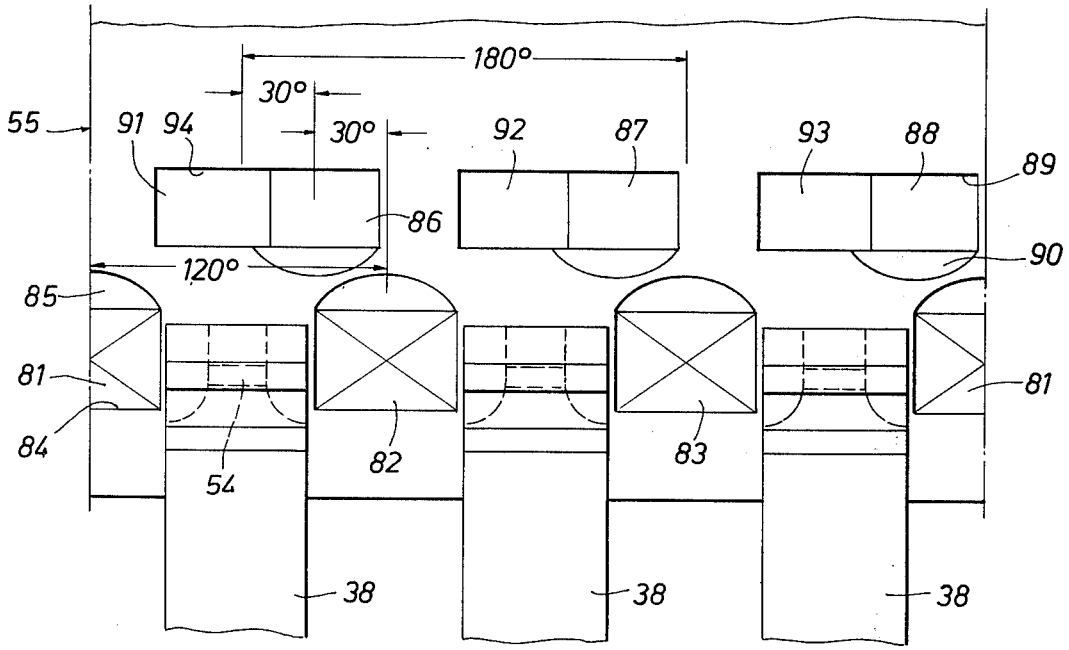
FIG. 11
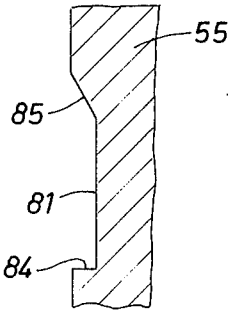
FIG. 12
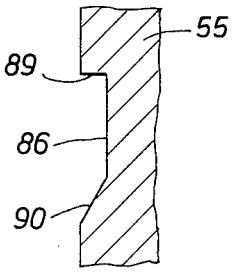
FIG. 13
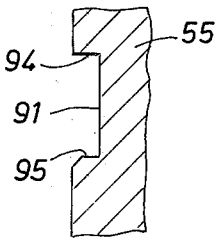
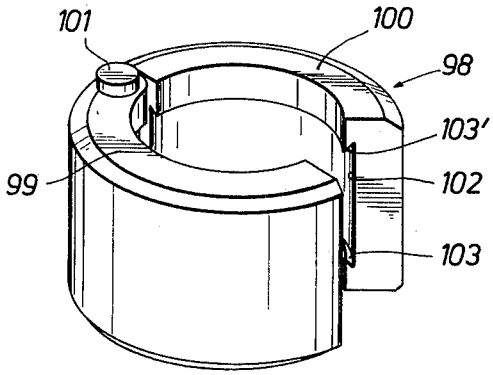
FIG. 14

PULLING AND RUNNING TOOL

This invention relates generally to well tools, and particularly to a new and improved apparatus for running and pulling subsurface production controls on wireline.

In accordance with typical oil well production techniques, subsurface controls such as chokes, flow regulators and safety valves are positioned at various elevations in the production tubing when the well is completed. The controls are suspended from hanger mandrels that are adapted to be seated and latched in landing nipples that are installed in the tubing for that purpose, or attached by slips to the tubing wall. The production controls and associated hanger mandrels normally are run into the productionn tubing, and removed therefrom when repair or replacement is necessary, through use of a running or a pulling tool that is attached to a flexible, steel measuring line, sometimes called a "wireline". A set of jars run above the running or pulling tool is employed to provide a jarring action pursuant to which the hanger mandrel is set or released by downward or upward jarring. The running or pulling tool itself is adaptable for downhole release from the hanger mandrel in the event that the latter is stuck or becomes lodged in the tubing for whatever reason. Where the hanger mandrel is of the type to be released by downward jarring, the running or pulling tool is released therefrom by upward jarring, with the opposite being the case where the mandrel is designed to be released by upward jarring.

In any event, the prior art has developed along the lines of providing separate and structurally distinct tools for different functions. That is to say, a pulling tool, for example, of one construction has been used when downward jarring is necessary for release of the mandrel, and an entirely different tool construction is used where it is necessary to jar upwardly to effect a release of the mandrel. The same design approach has been used for running tools, with the result that many different and complex types of tools have been developed with each tool being principally usable for only one particular function. There is, therefore, a need in the art for a single tool construction capable of performing a plurality of functions with only minimal change or adjustment.

One object of the present invention to provide a new and improved apparatus of the type described that can be preset by simple adjustment at the surface for utilization as either a pulling or a running tool.

Another object of the present invention is to provide a new and improved pulling and running tool that can be readily conditioned at the surface for either a jar-up or a jar-down release from an associated hanger mandrel.

Yet another object of the present invention is to provide a new and improved running tool that is adapted to position a hanger mandrel through use of a jar down and then up procedure.

These and other objects are attained in accordance with the concepts of the present invention through the provision of an apparatus comprising a tubular support having a plurality of elongated gripping members pivotally mounted thereon and yieldably urged toward a disengaged position. A control body is movably mounted in the upper end of the support and is adapted for connection to associated wireline equipment. The control body is provided with several sets of spaced apart holding surfaces and recess means that are arranged to coact with inwardly directed shoulders on the upper end of each gripping member to either position the members in gripping engagement, or to enable pivotal rotation thereon and release from an associated well device. The control body can be rotated within the support to one of several selected angular dispositions in order to vertically align a particular set of recess means with the shoulders, and can be releasably secured in either an upper or a lower position within the support, depending upon the function that the apparatus is to perform in the well, and the type of jarring action, either upward or downward, that is needed for release of the apparatus from the well device.

Consequently it will be recognized that the present invention provides a running and pulling tool apparatus that may be preadjusted in a straightforward and simple manner at the surface to perform any one of many desired functions in the well. Thus the present invention provides a single apparatus that can be used in place of several structurally distinct and different prior art tools, and in fact eliminates the need for such structurally different tools.

The present invention has other features, objects and advantages that will become more clearly apparent in connection with the following detailed description of one or more embodiments thereof, taken in conjunction with the appended drawings in which:

FIG. 1 is a schematic view showing a string of wireline tools suspended in a tubing string for pulling or running a subsurface production control;

FIG. 2 is an enlarged cross-sectional view of the pulling and running tool in accordance with the present invention;

FIG. 3 is a cross-section on line 3—3 of FIG. 2;

FIG. 4 is an enlarged fragmentary view to illustrate certain details of the pivotal connection of each gripping member;

Figure 15:
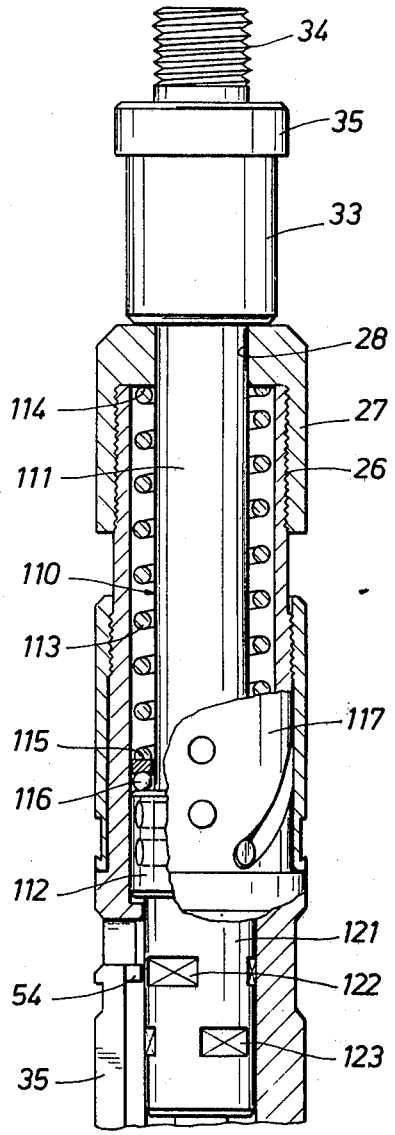
Figure 16:
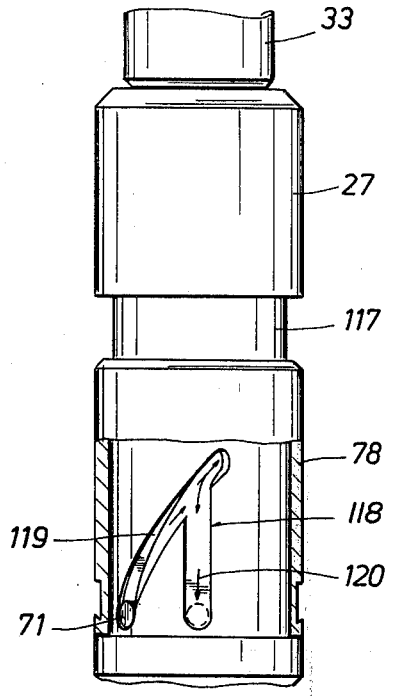

FIGS. 5 and 6 are cross-sections taken on lines 5—5 and 6—6, respectively, of FIG. 2;

FIG. 7 is a fragmentary elevational view of the upper section of the tubular support to show the angularly spaced guide pin slots therein;

FIGS. 8 and 9 are cross-sections on lines 8—8 and 9—9 of FIG. 2 to illustrate the shear pin locations;

FIG. 10 is a developed plan view of the lower section of the control body showing the various sets of recess means and their angular spacing relative to one another;

FIGS. 11–13 are fragmentary cross-sectional views to illustrate the wall surface configuration of the various recesses in the control body section;

FIG. 14 is an isometric view of a jaw assembly used at the surface to fully expand the gripping members;

FIG. 15 is a cross-sectional view of the upper end portion of a modified form of the present invention, primarily useful in setting and releasing delicate instruments such as a pressure gauge; and FIG. 16 is a fragmentary elevational view of the upper support section of the embodiment shown in FIG. 15 to illustrate the control slot and pin arrangement used therein.

Referring initially to FIG. 1, there is shown schematically a well production tubing 10 having a flexible line 11 disposed therein. The line 11 suspends a string of wireline tools including a socket 12, a weighted stem 13, a set of jars 14, and a pulling and running tool 15 constructed in accordance with the principles of the present invention. The tool 15 is releasably coupled to a conventional setting mandrel assembly 16 which is connected to any one of a wide variety of subsurface controls (not shown). The mandrel assembly 16 normally will include a pulling neck 20 having a flange 17 at its upper end with an undercut annular shoulder 18, the neck 20 being connected to a carrier ring 19 that suspend slips or dogs adapted to anchor in the tubing 10. The assembly is adapted to be located and locked within a landing nipple that is connected in the tubing 10 as will be apparent to those skilled in the art.

As shown in FIG. 2, the tool 15 comprises an elongated tubular support 25 that is connected by threads 26 to an upper sub 27 having a central opening 28 in the top. A generally cylindrical control body 30 is slidably positioned within the upper section 31 of the support 25, and has a reduced neck 32 that extends upwardly through the opening 28. A fishing head 33 is connected by suitable means to the upper end of the neck 32 and is provided with a threaded socket 34 for connection to the lower end of the jar 14. The head 33 also may be provided with an undercut, annular shoulder 35 in a typical manner.

The support 25, which is open at its lower end, carries a plurality of elongated gripping members 38 that are positioned within vertically extending windows 39 cut radially through the wall of the support. As shown in FIG. 3, each member 38 is mounted for pivotal rotation on the support 25 by a transversely arranged pin 40 having its ends received in holes 41 in the support 25 and its center extending through a slot 42 formed in the gripping member 38. The slot 42 is elongated as shown in FIG. 4 and has a generally vertical upper portion 43 and a lower portion 44 that inclines downwardly and inwardly toward the longitudinal axis of the support 25. The slot 42 enables limited vertical movement of the gripping member 38 relative to the support 25, and the inclination of the lower slot portion 44 provides a cam surface 45 that coacts with the pin 40 to force the member 38 laterally outwardly in the event of significant upward movement thereof. However, each of the respective gripping members 38 normally is maintained in a lower position relative to the support 25 by a coil spring 46 (FIG. 2) that reacts between a downwardly facing surface on the control body 30 and an upwardly facing surface 47 on a pivot spring carrier 48 that is coupled to each member by virtue of its engagement with inwardly extending shoulders 49 formed on each member.

A hook-like dog 52 is formed at the lower end of each gripping member 38 as shown in FIG. 2 and has an upwardly and inwardly inclined surface 53 that is complementary in shape to the undercut on the annular flange 17 of the mandrel assembly 16. The upper end of each member 38 has an inwardly directed shoulder 54 that slidably engages an external surface of the lower portion 55 of the control body 30. Each gripping member 38, as previously mentioned, is arranged for a limited amount of pivotal rotation about its pivot pin 40, and coil springs 56 that are received within radial bores 57 in the spring carrier 48 press outwardly as shown in FIG. 5 on the respective internal surfaces 58 of the members 38 in order to continuously urge the lower end portion of each member outwardly of the support 25.

A core 60 having an internal threaded bore 61, can be inserted into the lower open end of the tubular support 25 and attached thereto as shown in FIGS. 2 and 6 by lugs 62 that interfit within arcuate recesses 63 formed between oppositely facing shoulder surfaces 64, 65 therein. The core 60 functions to limit downward movement of the support 25 by engagement with the running neck of a mandrel assembly 16, and can be designed in various configurations and lengths depending upon the type of mandrel assembly to be pulled as will be apparent to those skilled in the art. Elongated openings 66 can be provided as desired through the wall of the support 25 so that fluids and debris and the like can pass freely therethrough.

As shown in FIGS. 2 and 7 the upper portion 31 of the support 25 has a pair of elongated, angularly spaced slots 69 and 70 formed therein for insertion of a guide pin 71 that fits within a diametrically extending aperture 72 in the control body 30. The length of the guide pin 71 is such that its outer end will extend into one of the slots 69 or 70 to set the relative angular disposition of the control body 30 within the support 25 during vertical movement. It will be apparent that at least three relative angular dispositions of the control body 30 within the support 25 are possible, a first position shown in FIG. 2 with the pin 71 in the slot 70, a second position where the body 30 is rotated 180° and the pin 71 placed in the same slot 70, and a third position as shown in FIG. 7 where the body 30 is rotated through a small angle and the pin 71 placed in the slot 69. Each one of the aforementioned positions is utilized to provide for a different function of the tool 15 as subsequently will be explained. Moreover, the control body 30 can be initially fixed in either an upper or a lower position within the support 25 for each angular disposition thereof, with appropriately placed shear pin holes 74, 75 and 76 being provided for this purpose as shown in FIGS. 8 and 9. A diametrically extending shear pin hole 73 is formed in the control body 30 which can be radially aligned with either the holes 74 or 76 in the first and second positions mentioned above, or with the hole 75 in the third position mentioned above. In the relative position of the control body 30 shown in FIG. 2, the hole 73 is aligned with the holes 74 and a pin 77 of selected shear strength is inserted to hold the control body in the upper position with respect to the support 25. A safety ring 78 is fitted over the support 25 adjacent the pin holes 74–76 and the slots 69, 70 in order to retain the parts in operative position, and to prevent pieces of the shear pin from dropping into the well. The ring 78 has threads 79 that mesh with companion threads on the support 25 so that the sleeve can be fed to an appropriate position to expose the pins and holes during assembly.

The outer peripheral surface of the lower section 55 of the control body 30 is shown in developed plan view in FIG. 10. A plurality of sets of circumferentially spaced recesses are formed therein, with the lower set of recesses, indicated by the numerals 81, 82 and 83, being angularly spaced at 120° intervals. The lower edge 84 of each of these recesses extends outwardly at right angles as shown in FIG. 11, whereas the upper wall 85 is tapered upwardly and outwardly to the outer surface of the section 55. A second set of recesses numbered 86, 87 and 88 are of substantially identical shape but oppositely disposed, providing flat upper walls 89 and inclined lower walls 90 as shown in FIG. 12. The recesses 86, 87 and 88 also are formed at 120° intervals, but are angularly offset to the left of the lower set of recesses by about 30°. A third set of recesses numbered 91, 92 and 93 also are provided at the same level as the recesses 86, 87 and 88 but are angularly offset to the left thereof by about 30°. Each of the recesses 91, 92, 93 has a flat upper wall surface 94, as well as a flat lower wall surface 95 as shown in FIG. 13. Each recess is adjacent to an uninterrupted external surface area of the control body section 55, lying either above or below it as the case may be, providing an arrangement whereby a different diameter surface of the section 55 can be positioned opposite the respective shoulders 54 on the gripping members 38 to cause pivotal rotation of the lower portions of the members from an inner, or active, position when the shoulders engage an uninterrupted or larger diameter surface area, to an outer or inactive position when the shoulders are permitted to enter the recesses and engage the lesser diameter inner wall surfaces thereof. Of course the pivot springs 56 continuously urge the members 38 to swing toward the outer or inactive positions.

OPERATION

When used as a pulling tool with a jar-down release, the parts are assembled and preset at the surface as shown in FIG. 2 with the guide pin 71 in the slot 70 (which conveniently can be marked "P" for ease of proper assembly), and the control body 30 fixed by the shear pin 77 in the upper position within the support 25. The shoulders 54 on the gripping members 38 are located in engagement with outer surface areas of the body section 55 which are aligned vertically with, and below, the upper recesses 91, 92 and 93 as illustrated in FIG. 10. These surface areas hold the upper portions of the gripping members 38 outwardly and thus cause the lower portions thereof to pivot inwardly to the active position. The tools are then lowered into the tubing 10 on the flexible line 11, and when the mandrel assembly 16 is reached, the open lower section or skirt of the support 25 telescopes over the connector head 20 as shown in FIG. 1. When the hooks or dogs 52 encounter the top surface of the undercut flange 17, which is fixed against downward movement, the weight of the tools causes the gripping members 38 to shift upwardly relative to the support 25, against the bias afforded by the coil spring 46. Such upward relative movement causes the cam surfaces 45 of the slots 42 to pivot the dogs 52 outwardly to a diameter sufficient to pass over the flange 17 and to a location where the surfaces 53 are below the undercut shoulder 18. As the dogs 52 clear the flange, the coil spring 46 forces the members 38 relatively downwardly, and with a snap action the dogs are pivoted inwardly as the pivot pins 40 reoccupy the upper position within the slots 42. The mandrel assembly 16, can be subjected to unlimited upward jarring action in order to release it, with the impact blows being transmitted via the control body 30 directly to the upper sub 27 and the support 25 so that there is no tendency to shear the pin 77. When the mandrel assembly 16 is freed, it and the subsurface control attached thereto can be lifted from the well by withdrawing the wireline 11.

In case it is necessary to release the tool 15 from the mandrel assembly 16, which could, for example, be sanded-in or stuck or otherwise inoperable, the jars 14 are extended and then dropped. The resulting impact blow applied to the control body 30 will be sufficient to shear the pin 77 and allow the control body to drop downwardly within the support 25, thus permitting the shoulders 54 to enter the recesses 91, 92 and 93, with corresponding outward pivotal movement of the lower portions of the members 38 to inactive position. The dogs 52 are thus released from the undercut flange 17 to enable the string of wireline tools to be withdrawn from the well. The tool 15 is withdrawn from the well with the dogs 52 locked in the outer or open position, since the shoulders 54 on the gripping members 38 will be held in the recesses 91, 92 and 93 by the lower flat walls 95 thereof.

When used as a pulling tool as described above but preset at the surface to enable a jar-up release from the mandrel assembly, the tool 15 is assembled with the control body 30 rotated 180° from that previously described to align the lower set of recess 81, 82 and 83 vertically below the shoulders 54, and the control body is shear pinned in the lower position within the support 25 using the holes 76 for that purpose. The exterior surfaces of the body section 55 located above these recesses thus coact with the shoulders 54 to retain the dogs 52 in the active position, so that the tool will automatically connect with the mandrel assembly 16 as described above. The mandrel assembly 16 may be subjected to unlimited downward jarring in order to release it, with the blows being transmitted by the fishing head 33 via the upper sub 27 directly to the support 25. Where necessary, the tool 15 can be released from the mandrel assembly 16 by collapsing the jars 14 and exerting a sharp upward pull on the wireline 11. This causes an upward impact blow to be applied to the control body 30, shearing the pin 77 and enabling upward movement of the body within the support 25. Such upward movement locate the shoulders 54 opposite the recesses 81, 82 and 83, enabling outward movement of the dogs 52 to the inactive or released position.

The tool 15 can be conditioned at the surface for use as a running tool with a jar-down and then up release that typically is necessary to set a mandrel assembly of the type having a tapered mandrel with a dog carrier slidably mounted thereon. For this function, the control body 30 is rotated within the support 25 to align the guide pin hole 72 with the slot 69 as shown in FIG. 7, (which may be marked "R" for convenience of assembly), and the pin 71 properly inserted. The control body 30 is located in the upper position by fitting the shear pin 77 in holes 73 and 75. This relative disposition of parts aligns the third set of recesses 86, 87 and 88 vertically above the shoulders 54 on the gripping members 38, which thus are initially held in the active position. An alternate core is used in the place of the element 60, having an internal recess sized for reception of the upper end of the running neck 21, and a pair of horizontal transverse holes adapted to receive tangential shear pins as will be appreciated by those skilled in the art. The pulling neck 20 which is slidable relatively along the running neck 21 and which has the undercut annular flange 17, is moved upwardly within the lower end of the support and into engagement with the latch dogs 52, which function to hold the carrier 19 in the upper position during running. The surface areas of the control body section 55 located below the set of recesses 86, 87 and 88 hold the gripping elements 38 in the active or closed position as the string of wireline tools, mandrel assembly and subsurface control are run into the tubing 10 on the wireline 11.

When the mandrel assembly is located in a preselected landing nipple in the tubing and seated therein, the running tool 15 is released in the following manner. A downward jarring force applied to the control body 30 disrupts the shear pin 77 and allows the body to shift downwardly within the support 25 so that the shoulders 54 on the members 38 enter the recesses 86, 87 and 88, thereby enabling the dogs 52 to pivot outwardly to the open position and release from the pulling neck shoulder 18. Next an upward jarring action is applied to the tool, which is transmitted from the control body 30 to the support 25 and via the lugs 62 to the core 60. Since the mandrel assembly 16 is locked against upward movement by its dog anchors that have engaged in the landing nipple, the impact force causes the tangential pins to be sheared, to release the running tool 15 from the running neck 21 and enable the tool to be retrieved to the surface.

In order to remove the mandrel assembly 16 from the grasp of the dogs 52 when the tools have been pulled to the surface, a set of jaws 98 as shown in FIG. 14 may be utilized. The jaws 98 are comprised of articulated, semicircular segments 99 and 100 that are hinged together by a pin 101. A groove 102 is formed internally of the segments 99 and 100, with the lower face 103 of the groove being inclined and shaped to mesh with arcuate ribs 104 formed at the upper end of each gripping member 38, and the upper face 103′ of the groove being oppositely inclined and adapted to mesh with an annular, outwardly directed shoulder 105 on the lower end of the safety ring 78. The lower surface 106 of each rib 104 and the upper surface 107 of the safety ring shoulder 105 also are inclined in opposite longitudinal directions to provide an automatic interlock when the jaws are placed in tension.

With the safety ring 78 in the lower position on the support 25, the jaws 92 can be positioned as shown in phantom lines in FIG. 2. Then a suitable tool is used to rotate the safety ring 78 in a direction appropriate to cause it to be advanced relatively upwardly along the support 25 by the threads 79. This causes the gripping members 38 to be jacked upwardly, and the cam surface 45 in the pivot pin slots 42 to expand the lower ends of the members 38 to release the dogs 52 from the pulling neck of the mandrel assembly 16.

This same procedure is used to interchange cores 60, as necessary, to run or pull a particular mandrel assembly. When the gripping members 38 are shifted outwardly to the maximum extent, the core 60 may be inserted through the open lower end of the support 25 with the lugs 62 radially aligned with the gripping members 38. When the lugs 62 are opposite the support recesses 63, a tool may be used to rotate the core 60 through an angle sufficient to position the lugs as shown in FIG. 6, whereupon the gripping members 38 are permitted to move downwardly and inwardly as the safety ring 78 is screwed back to its lower position. Of course the jaw segments 99 and 100 are swung outwardly to enable the assembly to be removed when the tools are ready to be run into the well.

Another embodiment of a running and pulling tool that is constructed in accordance with the principles of the present invention is shown in FIG. 15. Only the upper section of the tubular support and the control body are shown, since the gripping members and means for mounting them on the support are identical to that previously described. In this case the control body 110 is in the form of a plunger having a reduced diameter upper portion 111 and an enlarged diameter head or flange 112 intermediate its ends. A relatively strong coil spring 113 is mounted to surround the portion 111 and reacts between the lower face 114 of the upper sub 27 and the upper face 115 of an annular ball-type thrust bearing 116 that rests on top of the flange 112. The upper section 117 of the support 25 is provided with a control slot configuration shown generally at 118 in FIG. 16. The slot has an inclined groove 119 that extends upwardly and to the right at an angle of about 60°, and a vertically arranged groove 120 that intersects the inclined groove near the upper end of the latter. A guide pin 71 is received within a transverse hole in the flange 112 in such a manner that its outer end portion extends into the slot configuration 118 to provide a cam and follower arrangement.

The lower section 121 of the control body 110 has two sets of flats 122 and 123 or recesses formed identically with those described with respect to the previous embodiment, with the flats of each set being regularly spaced at 120° intervals, but with upper set of flats being angularly displaced with respect to the lower set by 60°.

In operation, the tool is assembled as shown with the guide pin 71 at the bottom of the inclined groove 119. The control body 110 occupies a lower position within the support 25 inasmuch as the coil spring 113 is relatively stronger than the lower coil spring. A hanger mandrel assembly is coupled to the gripping members as previously described, and the equipment is lowered into the tubing on wireline. When the mandrel reaches the appropriate landing nipple and is stopped against further downward movement and latched against upward movement in a conventional manner, the operator first pulls upwardly on the wireline. The control body 110 moves upwardly within the support 25, comprising the spring 113, and the guide pin 71 follows the inclined slot 119 to cause the control body 110 to rotate relative to the support 25. Such rotation moves the upper set of flats 122 to a position aligned vertically above the shoulders 54 on the gripping members 38. The wireline 11 then is lowered, and the guide pin 71 finds the vertical slot 120 and moves downwardly therein, allowing the upper flats 122 to be positioned opposite the shoulders 54. The lower ends of the gripping members 38 are thereby permitted to shift outwardly to the released position, so that the tool can be pulled out of the well.

This embodiment is useful primarily for setting and pulling a delicate instrument such as a downhole pressure gauge. Such instruments of course are shock sensitive, requiring a running and pulling tool with a "soft" release so as not to damage the instrument.

To convert the tool embodiment shown in FIG. 15 to a pulling tool, it is necessary only to replace the coil spring 113 and the thrust bearing 116 with a solid sleeve (not shown). The guide pin 71 is always located in the vertical slot 120. Thus the tool will function identically to the embodiment described previously in connection with FIG. 2. The control body 110 is shear-pinned in the upper position for pulling a mandrel by upward jarring; the tool can be released from the mandrel by downward jarring to position the upper set of flats 122 opposite the gripping member shoulders. The control body 110 is rotated 180° within the support 25 and then shear-pinned in the lower position in order to pull a mandrel by downward jarring. Release is effected by upward jarring to position the lower set of flats 123 opposite the gripping member shoulders 54.

In order to assist the operator in properly positioning the control body within the support for a particular function, suitable indicia may be placed on the top surface of the upper sub 27 and on the fishing head 33 to show the relative angular alignment at a glance.

It now will be recognized that a new and improved apparatus has been provided for running and pulling subsurface production controls on wireline. The apparatus can be preset at the surface to provide the desired pulling or running function as well as the desired jarring direction for release. It is unnecessary to disassemble the tool and substitute parts as has been the case for the prior art, whereby the present invention provides a single construction capable of performing many different functions that heretofore required structurally distinct tools. Since certain changes or modifications may be made in the disclosed embodiments without departing from the inventive concepts involved, it is the aim of the appended claims to cover all such changes and modifications falling within the true spirit and scope of the present invention.

We claim:

1. Apparatus adapted for running and pulling well devices, comprising: a tubular support; elongated gripping members pivotally mounted on said support and yieldably urged toward a disengaged position; a control body movable on said support between selected positions, said control body having first surface means engaging said gripping members in one of said selected positions to prevent disengagement of said members from a well device, and second surface means defining recess means cooperable with said members in another of said selected positions to enable disengagement of said members from a well device; and releasable means for fixing said control body initially in said one position, release of said releasable means enabling movement of said control body to said other position.

2. The apparatus of claim 1 wherein said first and second surface means are formed on different diameters of said control body, with said second surface means being on a lesser diameter than said first surface means.

3. The apparatus of claim 2 wherein said first and second surface means are vertically aligned, said control body being movable on said support between spaced apart upper and lower positions.

4. The apparatus of claim 3 further including guide means for fixing the relative angular position of said control body on said support.

5. The apparatus of claim 1 wherein said releasable means comprises a shear pin interfitted between said control body and said support, said shear pin being disrupted in response to a jarring blow applied to said control body.

6. Apparatus adapted for running and pulling well devices, comprising: a tubular support; elongated gripping members pivotally mounted on said support and yieldably urged toward a disengaged position, each of said members having an inwardly directed shoulder at its upper end; a cylindrical control body movable vertically within said support adjacent the upper ends of said gripping members, said control body having external surface means engaging said shoulders and holding said gripping members in engaged position, and a plurality of sets of circumferentially spaced recess means formed in the periphery thereof and adapted to be vertically aligned either above or below said shoulders and positioned to receive said shoulders and thereby enable release of said gripping members in response to downward or upward movement of said control body within said support.

7. The apparatus of claim 6 further including guide means for fixing the relative angular disposition of said control body within said support to thereby align selected sets of said recess means with said shoulders.

8. The apparatus of claim 7 further including shear pin means for setting the initial vertical position of said control body within said support.

9. The apparatus of claim 6 wherein said plurality of sets of recess means includes a first upper set adapted to receive said shoulders upon downward movement of said control body and a second lower set adapted to receive said shoulders upon upward movement of said control body, said first and second sets being angularly offset relative to one another.

10. The apparatus of claim 9 further including a third set of recess means located at the level of said first set and adapted to receive said shoulders upon downward movement of said control body, said third set being angularly offset relative to both said first and second sets.

11. The apparatus of claim 10 wherein each set of recess means is regularly spaced about said control body at 120° intervals, said first and second sets being angularly offset relative to one another by about 60° and said first and third sets being angularly offset relative to one another by about 30°.

12. The apparatus of claim 11 wherein each recess of said first set has means for locking said shoulders therein to prevent further engagement of said gripping members.

13. Apparatus adapted for running and pulling well devices, comprising: a tubular support; a plurality of elongated gripping elements carried by said support, each of said gripping elements having dog means at its lower end for grasping a well device; means for pivotally connecting each of said gripping elements to said support to enable lateral movement of said dog means between retracted and expanded positions, each of said connecting means including slot means intermediate the ends of a gripping element and a pin transversely arranged on said support and extending through said slot means, said slot means being elongated to enable limited vertical movement of said gripping elements relative to said support between a lower position and an upper position; spring means urging said gripping elements toward said lower position; and said slot means including a cam surface operable upon upward movement of said gripping elements due to engagement of the lower end of said dog means with a well device to cause movement of said dog means to an expanded position for interconnecting with said well device.

14. The apparatus of claim 13 further including control means movable on said support between selected positions, said control body having first surface means cooperable with said gripping elements in one position to hold said dog means in retracted position, and second surface means cooperable with said elements in another position to enable movement of said dog means to expanded position.

15. The apparatus of claim 13 further including an instrumentality operable for shifting said gripping elements jointly upwardly relative to said support to cause pivotal rotation thereof to released position.

16. The apparatus of claim 14 wherein said instrumentality comprises jaw means adapted to surround the upper ends of said gripping elements and interconnect therewith, and further including means on said support adapted to be interconnected with said jaw means for feeding said jaw means and said gripping elements upwardly along said support.

17. Apparatus adapted to position a device in a well conduit, comprising: a tubular support; elongated gripping members pivotally mounted on said support and yieldably urged toward a disengaged position; control means movable relative to said support and having first surface means alignable with said gripping members to hold said members in an engaged position, and second surface means angularly spaced with respect to said first surface means and alignable with said gripping members to permit disengagement thereof; and selectively operable means for indexing said control means from a first position where said first surface means are aligned with said gripping members to a second position where said second surface means are aligned therewith.

18. The apparatus of claim 17 wherein said indexing means includes cam slot and follower means for angularly displacing said control means from said first position to said second position in response to vertical movement of said control means relative to said support.

19. The apparatus of claim 18 wherein said cam slot means includes an inclined portion and a vertical portion intersecting said inclined portion, said inclined portion being coextensive with the angle of displacement of said control means, said vertical portion being aligned vertically with said second surface means.

20. The apparatus of claim 19 wherein said follower means comprises a guide pin extending into said cam slot means.

21. The apparatus of claim 18 wherein said control means is vertically movable relative to said support between spaced upper and lower positions, and further including yieldable means for urging said control means toward said lower position.

* * * * *